United States Patent [19]

Casanova et al.

[11] Patent Number: 4,635,447

[45] Date of Patent: Jan. 13, 1987

[54] TILTING COLD CABINET

[75] Inventors: Giuseppe Casanova, Trichiana; Ivano De Zolt, Bribano, both of Italy

[73] Assignee: Costan S.p.A., Limana, Italy

[21] Appl. No.: 713,881

[22] Filed: Mar. 20, 1985

[30] Foreign Application Priority Data

Mar. 21, 1984 [IT] Italy ..... 21304/84[U]

[51] Int. Cl.[4] ..... A25D 19/00

[52] U.S. Cl. ..... 62/448; 312/236

[58] Field of Search ..... 62/448; 16/230, 231; 312/116, 236

[56] References Cited

U.S. PATENT DOCUMENTS 3,455,061 7/1969 Kesling et al. ..... 16/230

3,721,363 3/1973 Bressler et al. ..... 16/230

FOREIGN PATENT DOCUMENTS 117861 5/1944 Australia ..... 62/448

*Primary Examiner*—James T. McCall

*Assistant Examiner*—Joseph Falk

*Attorney, Agent, or Firm*—Robbins & Laramie

[57] ABSTRACT

In a cold cabinet comprising a refrigerated chest, a base supporting the chest, a refrigeration unit is mounted on a frame pivoted on the base and connected to the chest. Such a cold cabinet is accessible from both sides to facilitate maintenance thereof.

2 Claims, 3 Drawing Figures

TILTING COLD CABINET

DESCRIPTION

The present invention relates to a tilting cold cabinet of the type comprising a refrigerated chest supported by a base and a refrigeration unit mounted in the base and connected to the chest, known in the art as an island cabinet.

In cold cabinets of the type specified above, the refrigeration unit is usually carried by a drawer or shelf which is slidable in suitable guides provided in the base. This particular type of structure gives rise to constructional complications in the making of the cabinet and also allows inspection of the refrigeration unit only at the side from which the drawer or shelf is removed.

It is evident, however, that cold cabinets of this type could be installed in various arrangements which, though optimising the integration of the cabinet into the furnishing of the area in which it is set up, could cause problems with regard to maintenance, making it necessary to remove the cabinet from its place of use to permit opening of the drawer or slidable shelf and to allow access to the refrigeration unit.

The object of the invention is to enable a refrigeration unit installed in the base of a cold cabinet to be accessible from both sides to facilitate maintenance thereof.

This object is achieved according to the invention by means of a tilting cold cabinet which is characterised in that the refrigeration unit is mounted on a support frame pivoted on the base.

Further characteristics and advantages of the invention will become more apparent from the detailed description of a cold cabinet according to the invention, illustrated purely by way of non-limiting example in the appended drawings, in which.

Figure 1:
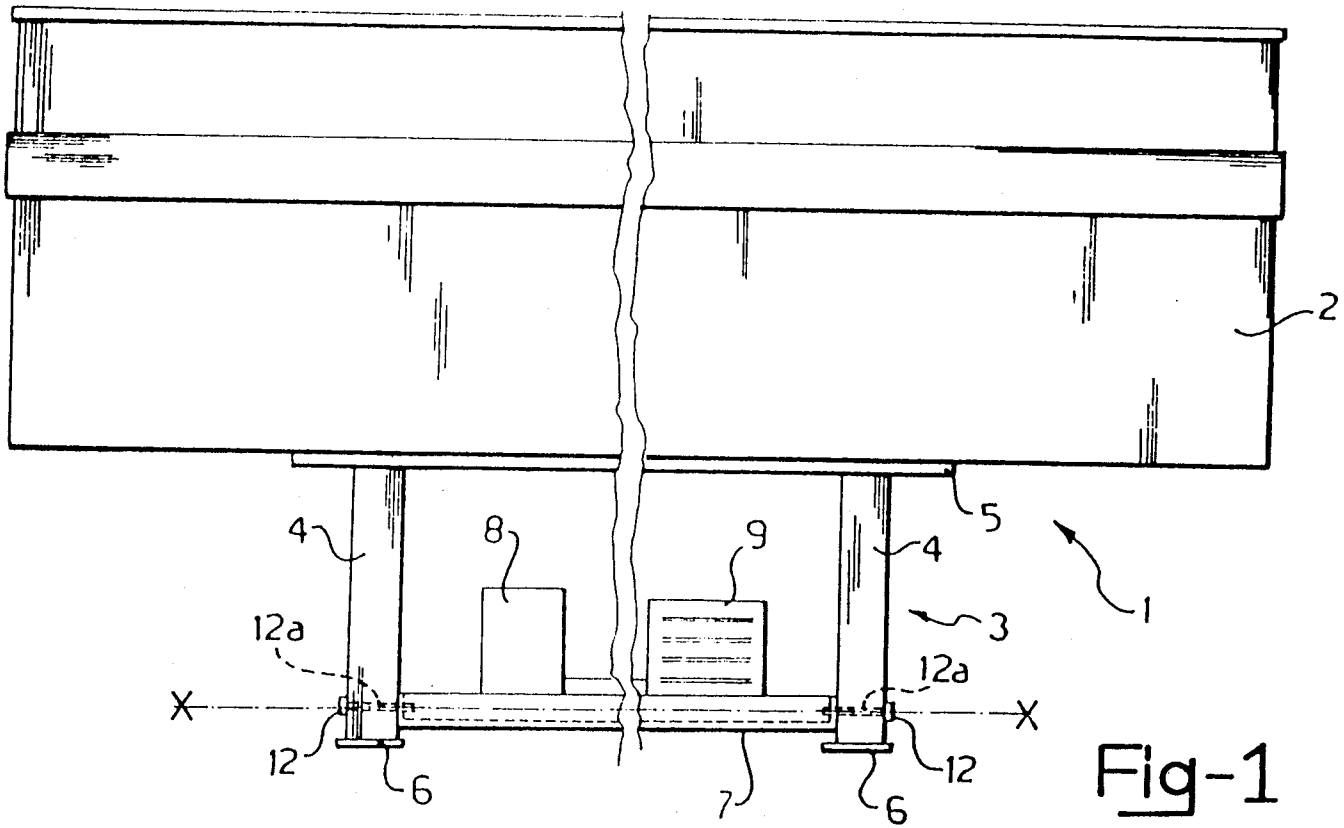
FIG. 1 is a front view of a cold cabinet according to the invention.

With reference to the drawings, a cold cabinet 1 comprises a refrigerated chest 2 supported by a base 3 formed by a series of legs 4 the upper ends of which are connected to the chest 2 by means of a plate 5 and the opposite ends of which have feet 6.

A frame 7 is mounted on the base 3 and supports a refrigeration unit consisting of one or more compressors 8 and one or more condensers 9; in its turn, the refrigeration unit is connected to an evaporator not shown, mounted within the chest 2 or, more precisely, in a space 10 therein where products to be kept normally rest.

The legs 4 are rigidly interconnected by cross members 11 which reinforce the structure of the base, allowing the chest 2 to rest firmly on the floor.

According to the invention, the frame 7 is formed as a sheet metal tray and is pivoted on the legs 4 close to their ends near the feet 6.

More precisely, the frame 7 is connected to the legs by means of removable pins 12 which each pass through a hole 12*a* in the corresponding leg and which articulate the frame 7 to the base about a first axis X and a second axis Y parallel to each other and to the major longitudinal dimension of the chest.

The axes X and Y pass through corresponding pairs of legs at a predetermined height so that, if a pair of pins 12 aligned on one of the said axes X or Y is withdrawn and the chest is rotated, being pivoted about the feet 6 of the legs still traversed by pins 12, the base 3 is raised together with the chest 2 while the frame 7 remains in its original position on the floor.

Figure 2:
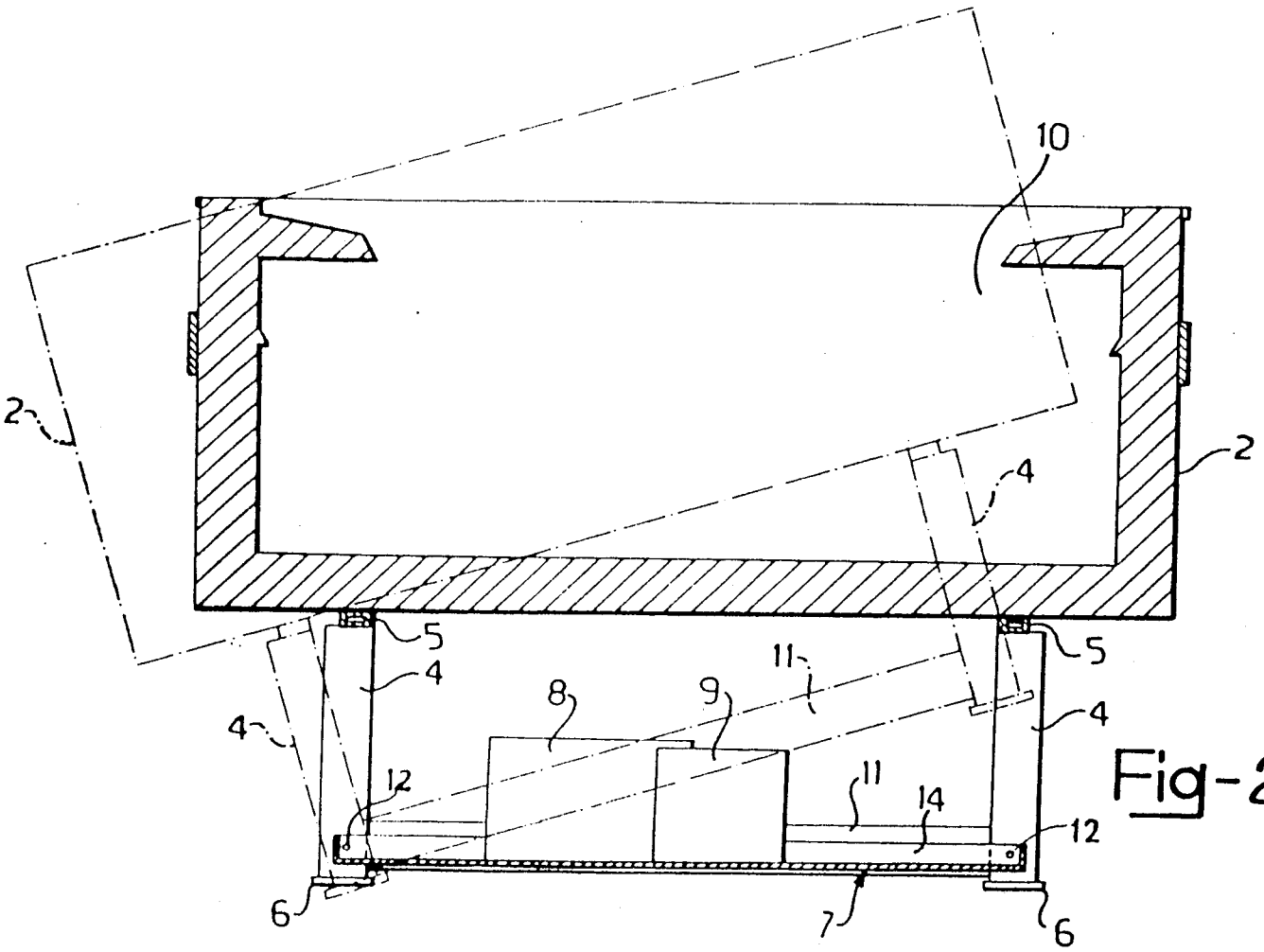
FIG. 2 is a cross-section of the same cold cabinet, the cabinet being shown in broken outline in its tilted position.
Figure 3:
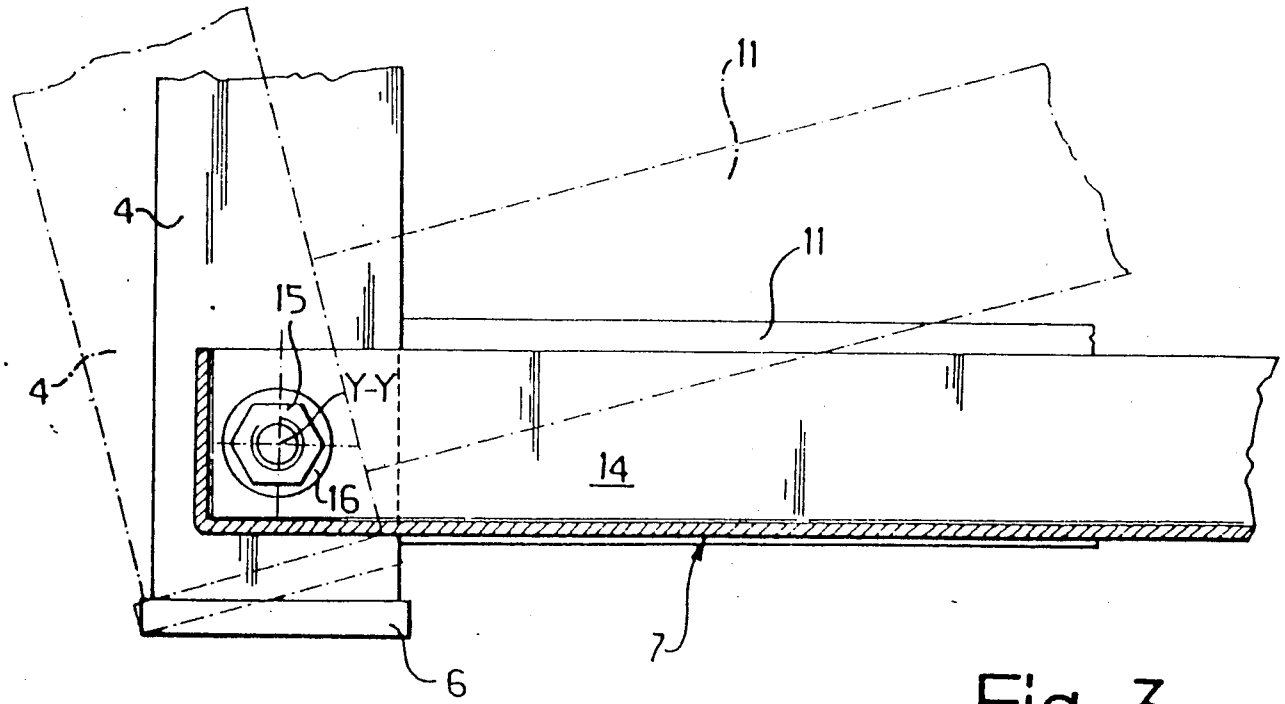
FIG. 3 shows a detail of the zone of rotary connection between the support frame of the refrigeration unit and a foot of the base.

With reference to FIGS. 2 and 3, the cabinet is shown in its rotated position, for example, for maintenance of the refrigeration unit, and in its normal operating position by broken lines and full lines respectively.

With particular reference to FIG. 3, in which a part of the zone of connection between a foot 4, a cross member 11 and the frame 7 is shown in detail, it can be seen how the tray-shaped frame is connected to the respective leg; more particularly, a side edge 14 of the frame 7 is pivoted to the leg 4 by means of a nut-and-bolt connection 15 provided with a washer 16.

The inspection and/or maintenance of a cold cabinet according to the invention is extremely simple and can be carried out from either side in that it suffices to withdraw the pins 12 corresponding to the legs which are to be raised in the partially tilted position of the chest, so that the frame 7 is free to rotate about the fulcrum constituted by the pins still in position.

The cold cabinet could then be held in the partially-tilted position by means of props or like equipment, which are known and therefore not illustrated, until the required operations have been completed.

Clearly, the pins 12 could be replaced by any other known types of suitable rotary connections such as, for example, pegs, hinges and the like.

From what has been described above, it will be clear that the invention achieves the proposed object with an extremely simple structure which is advantageous with respect to conventional drawers mounted on guides and which facilitates maintenance of the refrigeration unit without the need, in most cases, to move the cabinet from its normal position.

I claim:

1. A cold cabinet comprising: a refrigerated chest; a tiltable base including a plurality of legs, each fixed at one upper end to a lower portion of the chest for supporting the chest between upright and two tilted positions; a frame pivotally mounted to a lower end of the base; a refrigerator unit mounted on the frame and connected to the chest; removable pivot pin means interconnecting each leg of the base with the frame; pairs of adjacent legs having axially aligned opposed hole means, a lower end and the frame having corresponding holes, said holes for receiving the removable pivot pins therein along opposed parallel pivot axes, said refrigerated chest and base being tiltable about each pivot axis towards one of the tilted positions and in a direction away from the upright position and the refrigerated unit when the pivot pins in the opposite pivot axis are removed, thereby allowing alternate access to the refrigeration unit.

2. Cold cabinet according to claim 1, characterised in that the frame is tray-shaped.

* * * * *